US005736287A

United States Patent [19]

Kobayashi et al.

[11] Patent Number: 5,736,287

[45] Date of Patent: Apr. 7, 1998

[54] DEVELOPMENT METHOD

[75] Inventors: Makoto Kobayashi, Kobe; Hideaki Yasunaga, Sakai; Tomoharu Nishikawa, Hirakata; Koichi Takenaka, Itami, all of Japan

[73] Assignee: Minolta Co., Ltd.

[21] Appl. No.: 818,517

[22] Filed: Mar. 14, 1997

[30] Foreign Application Priority Data

Mar. 14, 1996 [JP] Japan ..... 8-087642
Mar. 14, 1996 [JP] Japan ..... 8-087643

[51] Int. Cl.[6] ..... G03G 13/09

[52] U.S. Cl. ..... 430/102; 430/122; 430/108; 430/111

[58] Field of Search ..... 430/102, 122, 430/108, 111

[56] References Cited

U.S. PATENT DOCUMENTS

| | | | |
|---|---|---|---|
| 4,447,517 | 5/1984 | Yuge et al. | 430/122 |
| 4,557,992 | 12/1985 | Haneda et al. | 430/122 |
| 4,600,675 | 7/1986 | Iwasa et al. | 430/106.6 |
| 4,675,267 | 6/1987 | Haneda et al. | 430/102 |
| 4,746,589 | 5/1988 | Haneda et al. | 430/120 |
| 4,797,335 | 1/1989 | Hiratsuka et al. | 430/35 |
| 4,847,176 | 7/1989 | Sano et al. | 430/106.6 |
| 4,885,222 | 12/1989 | Kaneko et al. | 430/102 |
| 4,968,573 | 11/1990 | Kaneko et al. | 430/106.6 |
| 5,318,873 | 6/1994 | Kawamura et al. | 430/122 |
| 5,336,580 | 8/1994 | Tavernier et al. | 430/122 |
| 5,346,791 | 9/1994 | Ozawa et al. | 430/106.6 |
| 5,395,717 | 3/1995 | Ozawa et al. | 430/122 |
| 5,472,817 | 12/1995 | Shibano et al. | 430/106.6 |

FOREIGN PATENT DOCUMENTS

| | | |
|---|---|---|
| 61-32858 | 2/1986 | Japan . |
| 62-182760 | 8/1987 | Japan . |
| 5-323681 | 12/1993 | Japan . |

*Primary Examiner*—Roland Martin

[57] ABSTRACT

A development method comprising the steps of forming a layer of a developer comprising a toner and a magnetic carrier on a developer transporting member containing a magnet therein by means of a developer regulating member, transporting the developer layer on the developer transporting member to a development region where the developer transporting member opposes an image bearing member, and applying an oscillating electric field to the development region for supplying the toner from the developer layer to the image bearing member, thereby developing an image. The magnetic carrier comprises a magnetic powder dispersed in a binder resin having an acid value of 0 to 20 KOHmg/g and has 5 to 30 wt % of magnetic powder present on the surface thereof.

20 Claims, 2 Drawing Sheets

DEVELOPMENT METHOD

BACKGROUND OF THE INVENTION

1. Field of the Invention

The present invention relates to a development method of developing a latent image by feeding thereto a toner material, the latent image formed on an image bearing member of an image forming apparatus such as copiers, printers and the like. More particularly, the invention relates to a development method comprising the steps of transporting a developer comprising a negative- or positive-charge toner material and a magnetic carrier to a development region opposite to the image bearing member by means of a developer transporting member and applying an oscillating electric field to the development region for supplying the toner material from the developer on the developer transporting member to the image bearing member, thereby developing the latent image into a toner image.

2. Description of the Related Art

Conventionally, image forming apparatuses, such as copiers and printers, have employed various development methods of developing a latent image formed on the image bearing member with toner materials. A typical development method known to the art comprises the steps of supplying a developer comprising a toner material and a magnetic carrier to the developer transporting member such as a developer sleeve; transporting the developer in the form of a magnetic brush to the image bearing member by means of the developer transporting member; regulating an amount of the developer on the developer transporting member by means of a regulating member and then delivering the developer to the development region opposite to the image bearing member; bringing the magnetic brush of the developer on the developer transporting member into contact with the surface of the image bearing member for supplying the toner material from the developer on the developer transporting member to a latent image portion on the image bearing member and thus developing the latent image into the toner image.

Unfortunately, in the development method wherein the latent image is developed by bringing the magnetic bush of the developer into contact with the image bearing member, the magnetic brush on the developer transporting member may scrape off the toner particles already deposited on the image bearing member, disturbing the formed toner image on the image bearing member. Particularly in the case of developing a multi-color image by sequentially supplying toner particles of different colors to the image bearing member, it is difficult to develop a preferred multi-color image precisely reproducing desired colors because a toner image on the image bearing member may be disturbed as scraped by a magnetic brush of a succeeding color coming into contact therewith, or mixed with a toner of an undesired color erroneously.

As to the development method wherein the latent image is developed by bringing the magnetic brush of developer into contact with the image bearing member, disturbance of the toner image formed on the image bearing member is supposedly caused by a rigid magnetic brush due to an excessive magnetic force of the magnetic carrier of the developer, or by a high residual charge remaining in the magnetic carrier, or so-called counter-charge thereof, after the toner particles have been transferred from the developer to the image bearing member.

In order to prevent the magnetic brush from disturbing the toner image, the prior-art development method is adapted such that the developer comprises a magnetic carrier having a low magnetic force so as to form a magnetic brush of soft bristles brought into contact with the image bearing member.

However, the magnetic carrier of low magnetic force results in a reduced force of binding the magnetic carrier itself to the developer transporting member and hence, the magnetic carrier tends to leave the developer transporting member and adhere to the image bearing member. In the case of an input image of high frequency, such as a ladder pattern or a "Kanji" character of many strokes, in particular, a greater amount of magnetic carrier become adhered to the image bearing member.

If the magnetic carrier becomes adhered to the image bearing member, the toner image together with the magnetic carrier are transferred to a copy sheet, thus producing white spots in the image thus transferred. Additionally, the magnetic carrier adhered to the image bearing member causes damage thereon, which damage results in streak-like or spot-like noises in the image thus formed.

Recently, an alternative development method has been developed for preventing the toner image formed on the image bearing member from being disturbed by the magnetic brush of developer, as disclosed in Unexamined Japanese Patent Publications No.61(1983)-32858 and No.62 (1984)-182760. Such a development method comprises the steps of transporting a two-component type developer comprising a toner and a carrier to the development region opposite to the image bearing member by means of the developer transporting member, applying the oscillating electric field to the development region for projecting the toner particles from the developer on the developer transporting member to the image bearing member instead of bringing the developer into contact with the image bearing member, and thus developing the image.

However, even in the method wherein the oscillating electric field is applied to the development region for projecting the toner particles from the developer to the image bearing member so as to develop the image without bringing the developer into contact with the image bearing member, the countercharge remains in the magnetic carrier after the toner particles are transferred from the developer to the image bearing member. There still remains unsolved the problem associated with the magnetic carrier adhered to the image bearing member.

For the purpose of suppressing the adhesion of the magnetic carrier to the image bearing member, Unexamined Japanese Patent No.5(1993)-323681 discloses a method wherein the developer transporting member transports a greater amount of developer to the image bearing member for reducing the consumption rate of the toner particles of the developer.

However, an increased amount of developer for the developer transporting member to transport to the image bearing member leads to an increased amount of toner particles scattered around instead of being supplied to the image bearing member when the oscillating electric field is applied to the development region for developing the image with the toner particles of the developer in the aforementioned manner. This results in a fogged image or contamination of the interior of a copier or the like with the scattered toner particles.

In addition, if an increased amount of developer is transported by the developer transporting member to the image bearing member, a great portion of the charged toner particles in the developer is not committed to the developing process, resulting in a reduced developing efficiency. Thus, a great amount of charged toner particles, as retained by the magnetic carrier on the developer transporting member, is returned to the interior of a developing unit, where the magnetic carrier together with the charged toner particles are not sufficiently agitated and mixed with replenished toner particles so that the replenished toner particles fail to be fully charged.

SUMMARY OF THE INVENTION

It is an object of the invention to provide a novel and effective development method solving the foregoing problems.

It is another object of the invention to provide a development method assuring stable production of favorable images.

It is yet another object of the invention to provide a development method assuring prevention of image disturbance by preventing a magnetic brush from scraping off the toner deposited on the image bearing member.

It is still another object of the invention to provide a development method effective at preventing the carrier from adhering to the image bearing member for elimination white spots in the printed image as well as at protecting the photoconductor drum against damage for elimination of streak-like or spot-like noises in the printed image.

It is another object of the invention to provide a development method assuring images free from fog by prohibiting the transportation of an excessive amount of developer to the development region for minimizing the scattered toner particles.

It is still another object of the invention to provide a development method allowing the toner to be sufficiently charged thereby preventing the charging failure.

For achieving the above objects, the development method in a mode of the invention comprises the steps of forming a layer of a developer comprising a negative-charge toner and a magnetic carrier on a developer transporting member containing a magnet therein by means of a developer regulating member, the carrier comprising a magnetic powder dispersed in a binder resin possessing an acid value of 0 to 20 KOHmg/g and having 5 to 30 wt % of magnetic powder present on the surface thereof; transporting the developer layer, as carried on the developer transporting member, to a development region where the developer transporting member opposes an image bearing member; and applying an oscillating electric field to the development region for supplying the toner from the developer layer thereby developing an image.

The development method in another mode of the invention comprises the steps of forming a layer of a developer comprising a positive-charge toner and a magnetic carrier on a developer transporting member containing a magnet therein by means of a developer regulating member, the carrier comprising a magnetic powder dispersed in a binder resin possessing an acid value of 20 to 70 KOHmg/g; transporting the developer layer, as carried on the developer transporting member, to a development region where the developer transporting member opposes an image bearing member; and applying an oscillating electric field to the development region for supplying the toner from the developer layer to the image bearing member, thereby developing an image.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
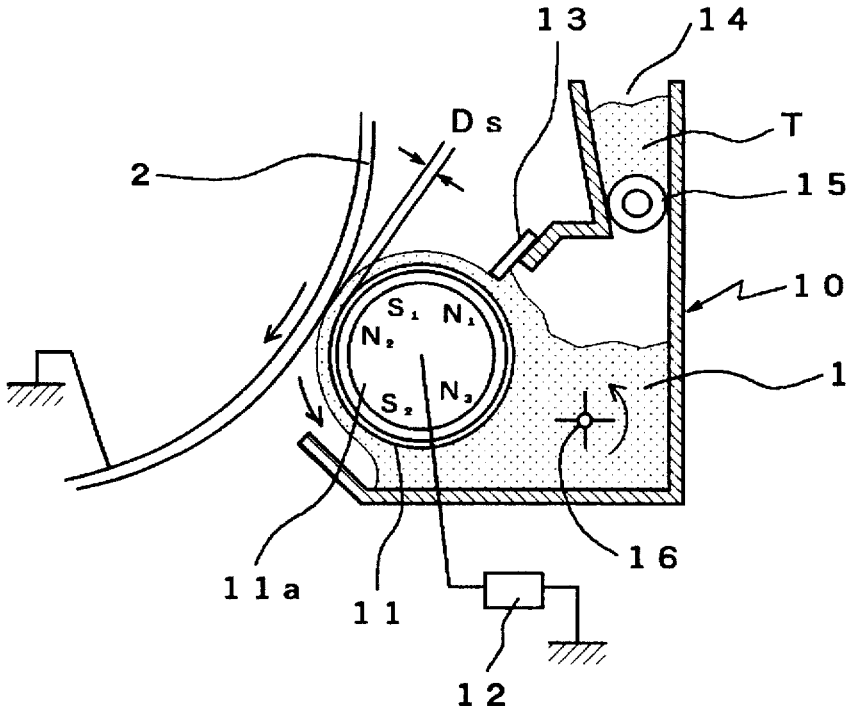
FIG. 1 is a schematic diagram illustrating an example of a developing unit employed for carrying out a development method of the invention.

A development method of the invention at least comprises the following steps 1 to 3:

1) forming a layer of a developer comprising negative- or positive-charge toner particles and magnetic carrier granules on a developer transporting member containing a magnet therein by means of a developer regulating member;
2) transporting the resultant developer layer on the developer transporting member to a development region where the developer transporting member opposes an image bearing member; and
3) applying an oscillating electric field to the development region so as to supply the toner particles from the developer layer to the image bearing member for development of an image.

Usable as the magnetic carrier is a so-called binder type carrier wherein magnetic powder is dispersed in a binding resin. In the case of the negative-charge toner, employed is a binder type carrier comprising a magnetic powder dispersed in a binder resin having an acid value of 0 to 20 KOHmg/g with 5 to 30 wt % of magnetic powder present on the surface thereof. In the case of a positive-charge toner, employed is a binder type carrier wherein a magnetic powder is dispersed in a binder resin having an acid value of 20 to 70 KOHmg/g.

In case where the developer comprising the toner and magnetic carrier in the above combinations is formed into a thin layer on the developer transporting member and transported to the development region opposite to the image bearing member, electric charge remaining in the magnetic carrier of the developer is smoothly moved when the oscillating electric field is applied to the development region for supplying the toner particles from the developer layer to the image bearing member and an image is developed. This prevents the magnetic carrier from adhering to the image bearing member while reducing an amount of toner particles which are scattered instead of being deposited on the image bearing member. Additionally, by virtue of an increased developing efficiency, a smaller amount of charged toner particles, as not committed to the developing process, is returned to a mixing/agitating unit within the developing unit so that the mixing/agitating characteristic (chargeability) of replenished toner particles (uncharged toner particles) may be enhanced. Furthermore, the replenished toner particles are adequately charged through exposure to the magnetic carrier granules and thus is assured a stable production of favorable images suffering no fog, insufficient density or density variation.

In combination with the negative-charge toner, a binder resin having an acid value greater than 20 KOHmg/g provides a magnetic carrier which is negatively overcharged to allow the toner to attain adequate negative charge even though the amount of the magnetic powder present on the surface of the carrier is regulated within the following range. This may cause the resultant images to suffer fog or density variation.

Further, in combination with the negative-charge toner, if the magnetic carrier has smaller than 5 wt % of magnetic powder present on the surface thereof, the magnetic carrier does not allow the negative-charge toner to be adequately charged through exposure to the magnetic powder. This may cause the resultant images to suffer fog, insufficient density or density variation. On the other hand, if the magnetic carrier has greater than 30 wt % of magnetic powder present on the surface thereof, the magnetic carrier has an insufficient resistive force and becomes more liable to adhere to the image bearing member. Therefore, the amount of the magnetic powder present on the surface of the magnetic carrier is preferredly in the range of from 10 to 25 wt %, and more preferredly from 10 to 20 wt %.

In combination with the positive-charge toner, on the other hand, a binder resin having an acid value smaller than 20 KOHmg/g provides a magnetic carrier with an insufficient capability of charging the positive-charge toner, which fails to achieve adequate positive charge. This may cause the resultant images to suffer fog or density variation. On the other hand, if the acid value is greater than 70 KOHmg/g, the magnetic carrier is reduced in the environmental resistance and is also negatively overcharged, resulting in the positively overcharged toner. This may cause the resultant images to suffer insufficient density. Therefore, it is desirable to use the binder resin having the acid value of 30 to 50 KOHmg/g.

On the other hand, if the developer transporting member supplies the development region with an insufficient amount of developer, the image bearing member is not supplied with sufficient toner particles, failing to produce an image of a sufficient density. For this reason, the developer transporting member is adapted to transport the developer to the development region in the amount of 0.7 to 10.0 mg/cm$^2$, or preferably 0.8 to 7.5 mg/cm$^2$, or more preferably 1 to 5 mg/cm$^2$.

Examples of the binder resin for use in the magnetic carrier include polyester resins, styrene copolymers, epoxy resins and the like.

The polyester resin is produced by condensing alcohol component with carboxylic acid, carboxylate, or carboxylic anhydride.

Examples of suitable diols for the alcohol component include bisphenol A polyoxyalkylene adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane and the like.

Examples of other diols include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol and the like, bisphenol A, hydrogenated bisphenol A, and other dihydric alcohols.

Examples of polyhydric alcohols containing three or more hydroxyl groups include sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, 1,3,5-trihydroxymethyl benzene and the like.

Examples of dihydric carboxylic acids include maleic acid, fumaric acid, citraconic acid, itaconic acid, glutaconic acid, phthalic acid, isophthalic acid, terephthalic acid, cyclohexanedicardicarboxylic acid, succinic acid, adipic acid, sebacic acid, azelaic acid, malonic acid, alkenylsuccinic acids such as n-dodecenylsuccinic acid, n-dodecylsuccinic acid and the like, alkylsuccinic acid, the anhydrides thereof, lower alkylester, and other dihydric carboxylic acids.

Examples of polyhydric carboxylic acids containing three or more hydroxyl groups include 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, 1,2,4-cyclohexanetricarboxylic acid, tetra(methylene carboxyl) methane, 1,2,7,8-octane tetracarboxylic acid, pyromellitic acid, Enbol trimer acid, the anhydrides thereof, lower alkyl esters and the like.

Suitable styrene copolymers may comprise a monomer such as ethylene unsaturated carboxylic acids including acrylic acid, methacrylic acid and the like, a monomer such as the following styrenes and, as required, the following monomers.

Examples of the styrene monomers include styrene, α-methyl styrene, p-methyl styrene, p-tert-butyl styrene, p-chlorostyrene and the derivatives thereof.

Examples of monomers copolymerized with the styrene monomer include, in addition to acrylic acid and methacrylic acid, methacrylates such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate and the like, acrylates such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate and the like, vinyls such as acrylonitrile, maleic acid, maleate, vinyl chloride, vinyl acetate, vinyl benzoate, vinyl methyl ethyl ketone, vinyl hexyl ketone, vinyl methyl ether, vinyl ethyl ether, vinyl isobutyl ether and the like.

In order to provide a lower acid value of the styrene copolymer, it is desirable to use ester methacrylate or ester acrylate as a monomer copolymerized with the styrene monomer.

The aforesaid binder type carrier may contain a carbon black for adjustment of the intrinsic resistance value thereof. A suitable carbon black has a BET specific surface area of 700 to 1400 m$^2$/g, or more preferably of 900 to 1300 m$^2$. More specifically, if the carbon black has a BET specific surface area smaller than 700 m$^2$/g, the carbon black has a greater particle size and hence, a greater portion of the carbon black is exposed on the surface of the carrier. This leads to an insufficient resistance value of the carrier, and thence, to an increased possibility of carrier adhesion. On the other hand, if the carbon black has a BET specific surface area greater than 1400 m$^2$/g, the carbon black has too small a particle size to allow proper adjustment of the resistance value of the carrier.

In case where the carbon black contained in the carrier has a pH of 7 or more, the carbon black, as exposed on the surface of the carrier, can improve the carrier in the capability of charging the negative-charge toner because the carbon black has a positive charge. For this reason, in case where the carrier is combined with the negative-charge toner, it is desirable for the carrier to contain therein a carbon black having a pH of 7 or more, and more preferredly a pH of 8 to 12. Inversely, if the negative-charge toner contains therein the carbon black as a colorant, it is desirable for the black carbon to have a pH smaller than 7, and more desirably 5 or less.

In preparation of the aforesaid binder type carrier, silica may be added for enhancement of the mixing characteristic of the binder resin and magnetic powder, thereby increasing the productivity of the carrier. A suitable silica has a BET specific surface area in the range of from 100 to 250 $m^2/g$, and more preferredly from 150 to 250 $m^2/g$. More specifically, if a BET specific surface area of the added silica is smaller than 100 $m^2/g$, the silica has a great particle size, resulting in a poor fluidity. This leads to a poor mixing characteristic of the binder resin and magnetic powder and hence, to a low productivity of the carrier. On the other hand, if the specific surface area is greater than 250 $m^2/g$, the silica has too small a particle size to allow for a uniform mixing of the binder resin and magnetic powder.

If a content of the magnetic powder in the aforesaid carrier is too small, the carrier has an insufficient magnetic binding force to bound itself to the developer transporting member, presenting a tendency to adhere to the image bearing member. If the carrier contains therein an excessive amount of magnetic powder, the carrier produces local agglomeration thereof on the developer transporting member, forming a coarse magnetic brush of the developer. This results in a failure to form a uniform thin layer of the developer on the developer transporting member. The resultant nonuniform layer of the developer causes the printed image to suffer density variation or renders a halftone or high-definition image of poor quality. Therefore, it is desirable to mix 150 to 500 parts by weight or more desirably 250 to 400 parts by weight of magnetic powder with 100 parts by weight of binder resin.

If the aforesaid carrier has too small a volumetric average particle size, the carrier is not sufficiently bound to the developer transporting member and becomes adhered to the image bearing member. If the carrier has too great a volumetric average particle size, a coarse magnetic brush of the developer is formed and therefore, a uniform thin layer of the developer is not formed on the developer transporting member. The resultant nonuniform layer of the developer causes the printed image to suffer density variation or renders a halftone or high-definition image of poor quality. Therefore, it is desirable to use a magnetic carrier having a volumetric average particle size ranging from 10 to 50 μm, or desirably from 20 to 45 μm, or more desirably from 25 to 40 μm.

If the carrier has an excessive dynamic current value, the charge level of the carrier is too small to adequately charge the toner particles. Additionally, when the developer transporting member is subject to the oscillating electric field for supplying the toner particles to the image bearing member, the carrier tends to adhere to the image bearing member. On the other hand, if the carrier has too small a dynamic current value, the carrier presents a low rising edge of charging or becomes overcharged as agitated with the toner particles. Furthermore, when an electrostatic latent image on the image bearing member is developed into a toner image, lines of electric forces transfer to the edge portion of the electrostatic latent image to intensify the electric field thereat so that an image with a particularly intensified edge portion is developed. For this reason, it is desirable for the carrier to have a dynamic current value in the range of from 5 to 50 nA, and more desirably from 15 to 45 nA.

In case where an insufficient oscillating electric field is applied between the developer transporting member and image bearing member in the development region for developing the latent image, only a small charge is moved from the carrier after the toner particles are projected and therefore, the countercharge remains in the carrier. This causes the carrier to become adhered to the image bearing member. On the other hand, if an excessive oscillating electric field is applied, there is a greater possibility of leakage of the charge from the developer transporting member and image bearing member. It is therefore desirable to satisfy the condition of $3.5\ kV/mm \leqq V_{p-p}/Ds \leqq 5.5\ kV/mm$, wherein "Ds" represents a gap between the developer transporting member and image bearing member in the development region, "$V_{p-p}$" represents a peak-to-peak value of AC voltage applied, and "$V_{p-p}/DS$" represents a level of the oscillating electric field.

Now referring to the accompanying drawings, detailed description will hereinbelow be given on a mode of the development method according to the invention. FIG. 1 is a diagram illustrating an example of a developing unit employed for carrying out the development method of the invention.

As seen in FIG. 1, a developing unit 1 contains therein a developer 1 comprising a toner T and a carrier. As a developer transporting member 11 for transporting the developer 1, employed is a cylindrical developer sleeve 11 having on the inner circumference thereof a magnetic roller 11a with a plurality of magnetic poles, N1, S1, N2, S2 and N3. The developer sleeve 11 is rotatable and adapted to oppose a photoconductor drum 2 as an image bearing member 2 as spaced therefrom by a suitable distance Ds in a development region.

The developer sleeve 11 is rotated in an opposite direction to that of the photoconductor drum 2. More specifically, in the development region where the developer sleeve 11 and photoconductor drum 2 oppose to each other, the developer sleeve 11 and photoconductor drum 2 are so rotated as to move in the same direction whereby the developer 1 stored in the developing unit 10 is transported by the rotating developer sleeve 11 to the photoconductor drum 2 as rendered into a magnetic brush by means of the magnetic force of the magnetic roller **11*a***.

The developer sleeve 11 is connected to a developing bias source 12 which applies a developing bias voltage produced from AD voltage or by superimposing DC voltage on AC voltage thereby subjecting the development region to the oscillating electric field.

A magnetic blade 13 is disposed upstream of the development region in a direction in which the developer is transported and opposite relative to the magnetic pole N1 of the magnetic roller **11*a*. The magnetic blade 13 is spaced from the developer sleeve 11 by a required distance for regulating an amount of the developer 1 on the developer sleeve 11**.

The developing unit 10 is provided with a toner reservoir 14 at the upper portion thereof, which contains therein the toner particles T and includes a toner supply roller 15. When the content of the toner of the developer 1 becomes low after the toner on the developer sleeve 11 was supplied to the photoconductor drum 2 for development of the image, the toner supply roller 15 is caused to rotate to replenish the developer 1 in the developing unit 10 with the toner particles T from the toner reservoir 14. The toner particles T thus replenished are mixed and agitated with the developer 1 by means of an agitating member 16 and supplied to the developer sleeve 11.

In the developing unit 10, the magnetic blade 13, upstream of the development region in the developer transport direction, regulates the amount of the developer 1 on the developer sleeve 11 while rendering the developer into a thin layer thereon. The developer sleeve 11 transports the developer layer to the development region where the sleeve opposes the photoconductor drum 2. The oscillating electric field is produced in the development region by applying the developing bias voltage from the developing bias voltage source 12, whereby the toner particles T in the developer 1 on the developer sleeve 11 are projected to a portion of an electrostatic latent image formed on the photoconductor drum 2 for development of the image.

The following tests were conducted by using developers 1 comprising different types of toner particles and binder carriers in the above developing unit 10 so as to prove that it is desirable to use binder type carriers satisfying the conditions of the invention.

EXAMPLES 1–10

As the binder resin for use in the carrier, seven types of resins 1–7 having different acid values were prepared in the following manners.

To prepare the resin 1, 120 g of styrene and 80 g of butyl methacrylate were put in a flask filled with nitrogen and the interior temperature thereof was raised to 130° C. At this temperature, the mixture was polymerized for 10 hours and then 100 g of xylene was added thereto. Subsequently, a solution consisting of 0.5 g of azobisisobutyronitrile and 100 g of xylene was continuously added in 10 hours to the mixture maintained at 140° C. which was further polymerized for 2 hours to give the resin 1. According to measurement based on JIS K5400, an acid value of the resin 1 was 0 KOHmg/g.

To prepare the resin 2, 120 g of styrene, 75 g of butyl methacrylate and 5 g of methacrylic acid were put in a flask filled with nitrogen and the subsequent steps were performed in the same manner as the preparation of the resin 1 so as to give the resin 2. An acid value of the resin 2 was 3 KOHmg/g.

To prepare the resin 3, 100 g of styrene, 50 g of butyl methacrylate, 40 g of methyl methacrylate and 10 g of methacrylic acid were put in a flask filled with nitrogen. The subsequent steps were performed in the same manner as the preparation of the resin 1 so as to give the resin 3. An acid value of the resin 3 was 5 KOHmg/g.

To prepare the resin 4, 110 g of styrene, 75 g of butyl methacrylate and 15 g of methacrylic acid were put in a flask filled with nitrogen. The subsequent steps were performed in the same manner as the preparation of the resin 1 so as to give the resin 4. An acid value of the resin 4 was 8 KOHmg/g.

To prepare the resin 5, 370 g of polyoxypropylene(2.2)-2,2-bis(4-hydroxyphenyl)propane, 150 g of polyoxyethylene(2.2)-2,2-bis(4-hydroxyphenyl)propane, 230 g of dimethyl terephthalate, and 40 g of isododecenyl succinic anhydride were put in a four-necked glass flask of 3 litters, which was equipped with a thermometer, a stainless steel stirrer, a down-flow type condenser and nitrogen introduction tube. The flask was installed in a mantle heater so that the mixture was reacted by stirring under the stream of nitrogen at a temperature of 200° C. and thus was produced the resin 5. An acid value of the resin 5 was 2 KOHmg/g.

To prepare the resin 6, 110 g of styrene, 30 g of butyl methacrylate and 60 g of methacrylic acid were put in a flask filled with nitrogen. The subsequent steps were performed in the same manner as the preparation of the resin 1 so as to give the resin 6. An acid value of the resin 6 was 30 KOHmg/g.

To prepare the resin 7, 350 g of polyoxypropylene(2.2)-2,2-bis(4-hydroxyphenyl)propane, 330 g of polyoxyethylene(2.2)-2,2-bis(4-hydroxyphenyl)propane, 400 g of isophthalic acid, 80 g of 1,2,4-benzenetricarboxylic acid and 2 g of dibutyltin oxide were put in a four-necked glass flask of 3 litters. The subsequent steps were performed in the same manner as the preparation of the resin 5 so as to give the resin 7. An acid value of the resin 7 was 45 KOHg/g.

The following binder type carriers A–J were prepared by using the aforesaid resins 1–7.

To prepare the carrier A, 100 parts by weight of the resin 1 having the acid value of 0 KOHmg/g and a Tg of 60° C., 400 parts by weight of magnetic powder (available commercially as EPT-1000 from Toda Industries Ltd.), 5 parts by weight of carbon black having a BET specific surface area of 950 $m^2/g$ and a pH of 9.5 (available commercially as Ketchen Black EC from Lion Yushi K.K.), and 2 parts by weight of silica having a BET specific surface area of 170 $m^2/g$ (available commercially as H 2000 from Wacker K.K.) were used.

The above ingredients were sufficiently blended in a Henschell Mixer and then were melt-kneaded by a vent-type two-shaft kneader as maintained at 180° C. The resultant mixture was cooled and roughly pulverized by a feather mill, further pulverized into fine particles by a jet mill (IDS-2 model). Subsequently, the resultant fine particles were subject to air classification and heat-treated at 300° C. by a suffusing system (SFS-1 model available from Japan Pneumatic Industries Co., Ltd.) so as to give the carrier granules A having the average particle size of about 35 μm.

To prepare the carrier B, 100 parts by weight of the resin 2 having the acid value of 3 KOHmg/g and a Tg of 62° C., 350 parts by weight of magnetic powder (available commercially as MFP-2 from TDK Corporation), 3 parts by weight of carbon black having a BET specific surface area of 950 $m^2/g$ and a pH of 9.5 (available commercially as Ketchen Black EC from Lion Yushi K.K.) and 1.5 parts by weight of silica having a BET specific surface area of 180 $m^2/g$ (available commercially as #200 from Nippon Aerosil K.K.) were sufficiently blended. The resultant mixture was subject to the same process as the preparation of the carrier A so as to give the carrier granules B having the average particle size of about 30 μm.

To prepare the carrier C, 100 parts by weight of the resin 3 having the acid value of 5 KOHmg/g and a Tg of 60° C., 400 parts by weight of magnetic powder (available commercially as EPT-1000 from Toda Industries Ltd.), 2 parts by weight of carbon black having a BET specific surface area of 1270 $m^2/g$ and a pH of 9.5 (available commercially as Ketchen Black EC-DJ600 from Lion Yushi K.K.) and 2 parts by weight of silica having a BET specific surface area of 170 $m^2/g$ (available commercially as H2000 from Wacker K.K.) were sufficiently blended. The resultant mixture was subject to the same process as the preparation of the carrier A so as to give the carrier granules C having the average particle size of about 30 μm.

To prepare the carrier D, 100 parts by weight of the resin 4 having the acid value of 8 KOHmg/g and a Tg of 61° C., 300 parts by weight of magnetic powder (available commercially as RB-BL from Titanium Industry Co., Ltd.), 5 parts by weight of carbon black having a BET specific surface area of 1270 $m^2/g$ and a pH of 9.5 (available commercially as Ketchen Black EC-DJ600 from Lion Yushi K.K.) and 3 parts by weight of silica having a BET specific surface area of 225 $m^2/g$ (available commercially as H3004F from Wacker K.K.) were sufficiently blended. The resultant mixture was subject to the same process as the preparation of the carrier A so as to give the carrier granules D having the average particle size of about 35 μm.

To prepare the carrier E, 100 parts by weight of the resin 5 having the acid value of 2 KOHmg/g and a Tg of 60° C., 400 parts by weight of magnetic powder (available commercially as RB-BL from Titanium Industry Ltd.), 5 parts by weight of carbon black having a BET specific surface area of 1180 $m^2/g$ and a pH of 9.5 (available commercially as Ketchen Black EC-DJ500 from Lion Yushi K.K.), and 3 parts by weight of silica having a BET specific surface area of 180 $m^2/g$ (available commercially as #200 from Nippon Aerosil K.K.) were sufficiently blended. The resultant mixture was subject to the same process as the preparation of the carrier A so as to give the carrier granules E having the average particle size of about 40 μm.

To prepare the carrier F, 100 parts by weight of the resin 3 having the acid value of 5 KOHmg/g and a Tg of 60° C., 250 parts by weight of magnetic powder (available commercially as MFP-2 from TDK Corporation), 8 parts by weight of carbon black having a BET specific surface area of 950 $m^2/g$ and a pH of 9.5 (available commercially as Ketchen Black EC from Lion Yushi K.K.) and 2 parts by weight of silica having a BET specific surface area of 180 $m^2/g$ (available commercially as #200 from Nippon Aerosil K.K.) were sufficiently blended. The resultant mixture was subject to the same process as the preparation of the carrier A so as to give the carrier granules F having the average particle size of about 30 μm.

To prepare the carrier G, 100 parts by weight of the resin 6 having the acid value of 30 KOHmg/g and a Tg of 60° C., 300 parts by weight of magnetic powder (available commercially as RB-BL from Titanium Industry Ltd.), 5 parts by weight of carbon black having a BET specific surface area of 94 $m^2/g$ and a pH of 9.0 (available commercially as REGAL330 from CABOT Inc.) and 3 parts by weight of silica having a BET specific surface area of 170 $m^2/g$ (available commercially as H2000 from Wacker K.K.) were sufficiently blended. The resultant mixture was subject to the same process as the preparation of the carrier A so as to give the carrier granules G having the average particle size of about 35 μm.

To prepare the carrier H, 100 parts by weight of the resin 7 having the acid value of 45 KOHmg/g and a Tg of 65° C., 400 parts by weight of magnetic powder (available commercially as RB-BL from Titanium Industry Ltd.), 5 parts by weight of carbon black having a BET specific surface area of 950 $m^2/g$ and a pH of 9.5 (available commercially as Ketchen Black EC from Lion Yushi K.K.) and 3 parts by weight of silica having a BET specific surface area of 250 $m^2/g$ (available commercially as R976 from Nippon Aerosil K.K.) were sufficiently blended. The resultant mixture was subject to the same process as the preparation of the carrier A so as to give the carrier granules H having the average particle size of about 40 μm.

To prepare the carrier I, 100 parts by weight of the resin 7 having the acid value of 45 KOHmg/g and a Tg of 65° C., 300 parts by weight of magnetic powder (available commercially as MFP-2 from TDK Corporation), 8 parts by weight of carbon black having a BET specific surface area of 250 $m^2/g$ and a pH of 3.5 (available commercially as #970 from Mitsubishi Chemical Co., Ltd.) and 2 parts by weight of silica having a BET specific surface area of 180 $m^2/g$ (available commercially as #200 from Nippon Aerosil K.K.) were sufficiently blended. The resultant mixture was subject to the same process as the preparation of the carrier A except for heat-treatment was not performed. Thus were obtained the carrier granules I having the average particle size of about 30 μm.

To prepare the carrier J, 100 parts by weight of the resin 7 having the acid value of 45 KOHmg/g and a Tg of 65° C., 400 parts by weight of magnetic powder (available commercially as RB-BL from Titanium Industry Co., Ltd.), 5 parts by weight of carbon black having a BET specific surface area of 950 $m^2/g$ and a pH of 9.5 (available commercially as Ketchen Black EC from Lion Yushi K.K.) and 3 parts by weight of silica having a BET specific surface area of 250 $m^2/g$ (available commercially as R976 from Nippon Aerosil K.K.) were sufficiently blended. The resultant mixture was subject to the same process as the preparation of the carrier A except for that the resultant fine particles were heat-treated at 350° C. Thus were obtained the carrier granules J having the average particle size of about 40 μm.

The average particle size of the respective carrier granules A-J was determined based on the respective relative volume distributions by particle size obtained by measurement thereof by using a Coulter Multisizer (available from Coulter Counter Inc.) having an aperture tube 280 μm in diameter.

As to each of the carriers A–J thus obtained, the dynamic current value and the amount of magnetic powder present on the surface of the carrier were determined. Table 1 shows the results of the measurement along with the acid values of the binder resins used in the carriers A–J.

Figure 2:
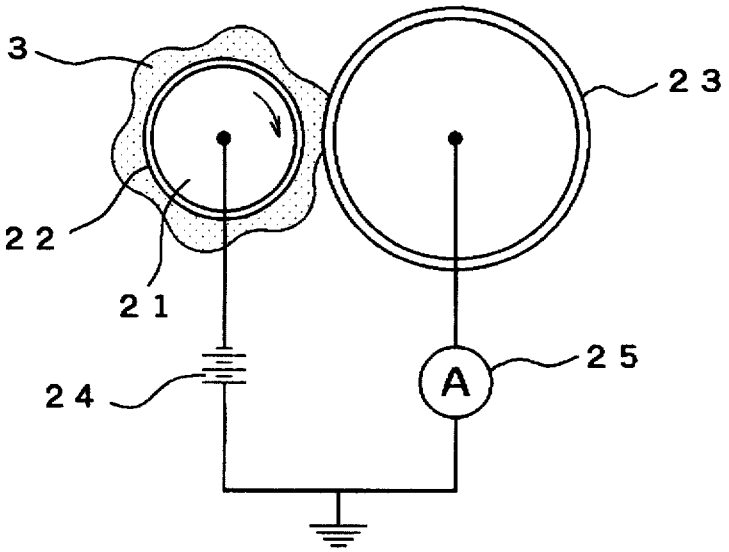
FIG. 2 is a schematic diagram illustrating a state in which a dynamic current value of the magnetic carrier is measured.

The dynamic current value of each carrier A–J was measured by means of an arrangement shown in FIG. 2. More specifically, 5 g of carrier 3 was supplied to the surface of a sleeve roller 22 accommodating a magnetic roller 21 and having a magnetic flux density of 1000 gausses. The sleeve roller 22 was spaced from an electrode tube 23 by 1 mm. A DC voltage of 500 V from a DC voltage source 24 was applied to the magnetic roller 21 rotated at a speed of 50 rpm and a value of current flow to the electrode tube 23 via the carrier 3 was measured by means of an ammeter 25. The measurement represents the dynamic current value.

The amount of magnetic powder on the surface of each of the carriers A–J was determined by the following steps. The magnetic powder was dissolved in diluted hydrochloric acid and a spectral transmittance of the resultant solution was measured with a spectrophotometer. A calibration curve was prepared by plotting wavelengths λ for the spectral transmittance of 50% versus contents of the magnetic powder in the solution. A given amount of each of the carriers A–J and a given amount of diluted hydrochloric acid was measured to prepare a sample thereof. Each of the carrier A–J was mixed with the diluted hydrochloric acid in a glass vessel for 30 minutes so that the magnetic powder on the surface of each carrier was eluted therefrom. The resultant eluate was filtered and subjected to the spectrophotometer for measurement of the spectral transmittance so as to find a wavelength for the spectral transmittance of 50%. Thus, the amount of the magnetic powder in the solution was determined based on the above calibration curve.

TABLE 1

| Type of Carrier | A | B | C | D | E | F | G | H | I | J |
|---|---|---|---|---|---|---|---|---|---|---|
| Dynamic Current Value (μA) | 20 | 17 | 19 | 21 | 25 | 15 | 41 | 30 | 58 | 5 |
| Magnetic Powder on Surface (wt %) | 19 | 18 | 18 | 20 | 21 | 16 | 31 | 23 | 33 | 4 |
| Acid Value of Binder Resin | 0 | 3 | 5 | 8 | 2 | 5 | 30 | 45 | 45 | 45 |

Two types of toners a–b were prepared in the following manner as the toner mixed with the above carriers.

Two types of polyester resins (1) and (2) were prepared in the following manner and used as the binder resin for each of the toners a–b.

To prepare the polyester resin (1), 735 g of polyoxypropylene(2.2)-2,2-bis(4-hydroxyphenyl)propane, and 292.5 g of polyoxyethylene(2.0)-2,2-bis(4-hydroxyphenyl)propane, as alcohols, along with 448.2 g of terephthalic acid as dihydric carboxylic acid, and 22 g of trimellitic acid as trihydric carboxylic acid were put in 4-necked flask of 2 litters, which was equipped with a reflux condenser, a water separator, a nitrogen introduction tube, a thermometer and a stirrer. The 4-necked flask was installed in a mantle heater so that the mixture was reacted by stirring at a temperature of 220° C. in the presence of nitrogen introduced therein. The process of the reaction was traced by measuring the acid value so that the reaction was terminated when the acid value reached a predetermined level. Thus was obtained the polyester resin (1) having a softening point of 150.1° C.

To prepare the polyester resin (2), 735 g of polyoxypropylene(2.2)-2,2-bis(4-hydroxyphenyl)propane and 292.5 g of polyoxyethylene(2.0)-2,2-bis(4-hydroxyphenyl)propane, as alcohols, 249 g of terephthalic acid and 177 g of succinic acid as dihydric carboxylic acids, and 22 g of trimellitic acid as trihydric carboxylic acid were put in the above 4-necked flask. Then, the polyester resin (2) having a softening point of 150.1° C. was obtained in the same manner as the preparation of the polyester resin (1).

To prepare the toner a, 65 parts by weight of the polyester resin (1), 35 parts by weight of the polyester resin (2), 3 parts by weight of oxidized polypropylene (available commercially as Viscol TS-200 from Sanyo Chemical Industries Ltd.), 5 parts by weight of negative-charge control agent (available commercially as Bontron S-34 from Orient Chemical Industries Ltd.), and 8 parts by weight of carbon black having a pH of 2.5 (available commercially as MOGAL-L from CABOT Inc.) were adequately blended. Subsequently, the resultant mixture was melt-kneaded by a vent-type two-shaft kneader at 140° C. After cooling, the mixture was roughly pulverized by a feather mill. The resultant particles were finely pulverized by a jet mill and subject to air classification to give black particles having a volumetric average particle size of 9 μm. A mixture was obtained by adding 0.3 parts by weight of hydrophobic silica (available commercially as H-2000 from Wacker K.K.) to 100 parts by weight of the resultant black fine powder. The mixture was processed for 1 minute by a Henschell Mixer (available from Mitsui-Miike Kakoki Kaisha, Ltd.) rotated at 1000 rpm to thereby give the negative-charge toner a.

The toner b was prepared in the same manner as the preparation of the toner a, except for that the aforesaid negative-charge control agent (available commercially as Bontron S-34 from Orient Chemical Industries, Ltd.) was replaced by 5 parts by weight of metal complex salicylate (available commercially as E-84 from Orient Chemical Industries, Ltd.). Thus was obtained the negative-charge toner b having the average particle size of about 8.5 μm. Developers of Examples 1–10 were prepared by combining the carriers A–J and the toners a–b as shown in Table 2, respectively. The developers contained 10 parts by weight of toners, respectively.

Each of the developers thus prepared was determined on the charge level of the toner and the amount of countercharged toner. The results are also shown in Table 2.

To determine the charge level of the developers of Examples 1–9, each developer was put in a 50 cc plastic vessel placed on a rotary table, which was rotated at 120 rpm for 3, 10, 60 and 600 minutes, respectively.

Figure 3:
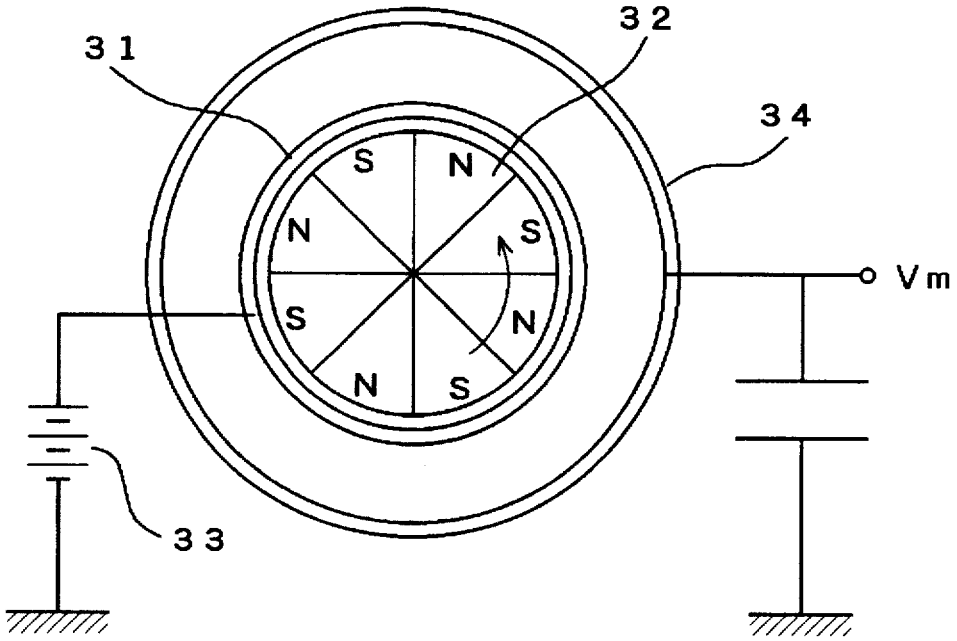
FIG. 3 is a schematic diagram illustrating a device used for measurement of a charge level of the toner.

The test was conducted using an apparatus shown in FIG. 3. Each of the developers thus prepared was weighed on a precision balance to obtain a sample of 1 g thereof. The sample thus obtained was uniformly applied to the surface of a conductive sleeve 31. The rotation speed of a magnetic roller 32 in the conductive sleeve 31 was set to 100 rpm. A bias voltage of 3 kV having the opposite polarity to that of the toner was applied by a bias voltage source 33 while the magnetic roller 32 was rotated for 30 seconds. Then, a potential level Vm of a cylindrical electrode 34 was read at the time when the magnetic roller 32 was stopped. On the other hand, an amount of toner fed from the conductive sleeve and deposited on the cylindrical electrode 34 was measured by means of the precision balance for determination of the average charge level (μC/g) of each of the toners.

The amount of countercharged toner of each of the developers of Examples 1–9 was determined as follows. A sample of each developer of Examples 1–9 was prepared by putting each developer in the plastic vessel, which was rotated for 60 minutes. Similarly to the above, each of the developers was uniformly applied to the surface of the conductive sleeve 31. A bias voltage of 1 kV having the same polarity with that of the toner was applied while the magnetic roller 32 was rotated in the same manner as the measurement of the charge level of the toner. An amount of toner deposited on the cylindrical electrode 34 was measured by means of the precision balance so as to determine the amount (wt %) of the countercharged toner with respect to the whole toner.

TABLE 2

| | Carrier | Toner | Charge Level (μC/g) 3-min | 10-min | 60-min | 600-min | Amount of Counter-charged Toner (wt %) |
|---|---|---|---|---|---|---|---|
| Ex. 1 | A | a | −25.0 | −25.3 | −25.5 | −24.8 | 1.0 |
| Ex. 2 | B | a | −23.9 | −24.8 | −24.5 | −24.7 | 0.5 |
| Ex. 3 | C | a | −26.1 | −25.5 | −26.8 | −26.7 | 0.7 |
| Ex. 4 | D | b | −23.5 | −23.0 | −23.0 | −23.1 | 1.3 |
| Ex. 5 | E | b | −22.0 | −21.8 | −22.1 | −22.5 | 1.2 |
| Ex. 6 | F | b | −25.0 | −26.0 | −26.1 | −26.0 | 0.5 |
| Ex. 7 | G | a | −10.8 | −15.0 | −19.8 | −20.1 | 5.1 |
| Ex. 8 | H | a | −14.1 | −17.5 | −18.1 | −21.5 | 4.1 |
| Ex. 9 | I | b | −8.1 | −12.5 | −15.0 | −12.9 | 10.1 |
| Ex.10 | J | b | −15.0 | −22.5 | −32.1 | −40.5 | 3.9 |

The results indicate that the developers of Examples 1–6 each present a stable charge level of the toner contained therein. As to the developers of Examples 7–9, in contrast, the toners contained therein each present a low rising edge of charging and fail to accomplish sufficient charging. The developer of Test Example 10, in particular, is overcharged although it presents a high rising edge of charging. The developers of Examples 1–6 each give a small amount of countercharged toner whereas the developers of Examples 7–10 give a great amount of countercharged toner.

Next, the developers of Examples 1–10 were each used in the developing unit 1 shown in FIG. 1, which was adjusted as follows. A gap between the developer sleeve 11 and magnetic blade 13 was adjusted so as to regulate an amount of the developer 1 to 5.0 mg/cm$^2$, the developer transported by the developer sleeve 11 to the development region. On the other hand, a minimum gap between the photoconductor drum 2 and developer sleeve 11 was adjusted to 0.3 mm. The photoconductor drum 2 was rotated at a circumferential speed of 165 mm/s whereas the developer sleeve 11 was rotated at a circumferential speed of 300 mm/s. The photoconductor drum 2 had a surface potential of −450 V at a portion thereof to which the toner T was supplied and a surface potential of −100 V at a portion thereof to which the toner T was not supplied.

Then, a developing bias voltage was applied to the development region where the developer sleeve 11 opposes the photoconductor drum 2, thereby developing a reverted image, which was transferred to a copy sheet. The printed image was subject to evaluation. The developing bias voltage was produced by superimposing a DC voltage of −350 V from the aforesaid developing bias voltage source 12 on an AC voltage having a peak-to-peak value Vp-p of 1.4 kV, a rectangular wave of frequency of 3 kHz and a duty ratio (development:recovery) at 1:1.

For evaluation of the resultant images, 100,000 copies were produced by the use of the individual developers. From these copies, the initial, the 10,000-th and the 100,000-th copies were picked up so that images thereon were each examined for the density variation, carrier adhesion and fog. The results are shown in Table 3. The respective images were visually inspected for the density variation and classified into five levels of quality. That is, an image free from density variation was given 5, an image with an insignificant degree of density variation 4, an image with some degree of density variation 3, an image with a high degree of density variation 2, and an image with a rather high degree of density variation 1. The images were also visually inspected for the carrier adhesion and classified into five levels of quality. That is, an image free from the carrier adhesion was given 5, an image with an insignificant degree of carrier adhesion 4, an image with some degree of carrier adhesion 3, an image with a high degree of carrier adhesion 2, and an image with a rather high degree of carrier adhesion 1. Likewise, the images were visually inspected for the occurrence of fog and classified into five levels of quality. That is, an image free from fog was given 5, an image with an insignificant degree of fog 4, an image with some degree of fog 3, an image with a high degree of fog 2, and an image with a rather high degree of fog 1.

TABLE 3

| | Density Variation | | | Carrier Adhesion | | | Fog | | |
|---|---|---|---|---|---|---|---|---|---|
| | Initial | 10000 -th | 100000 -th | Initial | 10000 -th | 100000 -th | Initial | 10000 -th | 100000 -th |
| Ex. 1 | 5 | 5 | 5 | 5 | 5 | 5 | 5 | 5 | 5 |
| Ex. 2 | 5 | 5 | 4 | 5 | 5 | 5 | 5 | 5 | 5 |
| Ex. 3 | 5 | 5 | 4 | 5 | 4 | 4 | 5 | 5 | 5 |
| Ex. 4 | 4 | 4 | 4 | 5 | 5 | 4 | 5 | 4 | 4 |
| Ex. 5 | 5 | 5 | 5 | 4 | 4 | 4 | 5 | 5 | 4 |
| Ex. 6 | 5 | 5 | 5 | 5 | 4 | 4 | 5 | 4 | 4 |
| Ex. 7 | 2 | 2 | 2 | 2 | 2 | 2 | 3 | 3 | 2 |
| Ex. 8 | 3 | 2 | 2 | 4 | 3 | 3 | 4 | 3 | 3 |
| Ex. 9 | 2 | 1 | 1 | 2 | 1 | 1 | 2 | 1 | 1 |
| Ex.10 | 1 | 1 | 1 | 5 | 4 | 4 | 4 | 3 | 2 |

As apparent from the results, Examples 1–6 comprising the binder type carriers satisfying the conditions of the invention assure stable production of favorable images substantially free from density variation, carrier adhesion and fog over a long period of time. In contrast, Examples 7–10 comprising the binder type carriers not satisfying the conditions of the invention produce images with appreciable density variation, carrier adhesion or fog in the early stage, or otherwise gradually deteriorated in the performance of rendering images of good quality in the long run.

EXAMPLES 11–19

Six types of binder resins 8–13 having different acid values were prepared in the following manner and used for binder type carriers, respectively.

To prepare the resin 8, 115 g of styrene, 40 g of butyl methacrylate and 45 g of methacrylic acid were put in a flask filled with nitrogen, the interior temperature of which was raised to 130° C. At this temperature, the mixture was polymerized for 10 hours. Subsequently, 10 g of xylene was added and then a solution consisting of 0.5 g of azobisisobutyronitrile and 100 g of xylene was continuously added to the mixture, as maintained at 140° C., over a period of 10 hours. The mixture was further polymerized for 2 hours to give the resin 8. According to measurement based on JIS K5400, an acid value of the resultant resin 8 was 22 KOHmg/g.

To prepare the resin 9, 110 g of styrene, 30 g of butyl methacrylate and 60 g of methacrylic acid were put in a flask filled with nitrogen. The subsequent steps were performed in the same manner as the preparation of the resin 8 to thereby give the resin 9 having an acid value of 30 KOHmg/g.

To prepare the resin 10, 350 g of polyoxypropylene(2.2)-2,2-bis(4-hydroxyphenyl)propane, 330 g of polyoxyethylene(2.2)-2,2-bis(4-hydroxyphenyl)propane, 400 g of isophthalic acid, 80 g of 1,2,4-benzene tricarboxylic acid and 2 g of dibutyltin oxide were put in a 4-necked glass flask of 3 litters, which was equipped with a thermometer, a stainless steel stirrer, a down-flow type condenser and a nitrogen introduction tube. The flask was installed in a mantle heater while the mixture was reacted by stirring under the stream of nitrogen at the temperature of 200° C. and thus was obtained the resin 10 having an acid value of 30 KOHmg/g.

To prepare the resin 11, 350 g of polyoxypropylene(2.2)-2,2-bis(4-hydroxyphenyl)propane, 330 g of polyoxyethylene(2.2)-2,2-bis(4-hydroxyphenyl)propane, 500 g of isophthalic acid, 80 g of 1,2,4-benzene tricarboxylic acid, 70 g of isooctenyl succinic acid, and 2 of dibutyltin oxide were put in a 4-necked flask. The subsequent steps were performed in the same manner as the preparation of the resin 10 to give the resin 11 having an acid value of 45 KOHmg/g.

To prepare the resin 12, 120 g of styrene and 80 g of butyl methacrylate were put in a flask filled with nitrogen. The subsequent steps were performed in the same manner as the preparation of the resin 8 to give the resin 12 having an acid value of 0 KOHmg/g.

To prepare the resin 13, 120 g of styrene, 75 g of butyl methacrylate and 5 g of methacrylic acid were put in a flask filled with nitrogen. The subsequent steps were performed in the same manner as the preparation of the resin 8 to give the resin 13 having an acid value of 3 KOHmg/g.

Next, nine types of binder type carriers K–S were prepared by using the above resins 8–13 as the binder resin.

To prepare the carrier K, 100 parts by weight of the resin 8 having the acid value of 22 KOHmg/g and a Tg of 60° C., 400 parts by weight of magnetic powder (available commercially as EPT-100 from Toda Industries Ltd.), 5 parts by weight of carbon black having a BET specific surface area of 950 $m^2/g$ (available commercially as Ketchen Black EC from Lion Yushi K.K.), and 2 parts by weight of silica having a BET specific surface area of 170 $m^2/g$ (available commercially as H2000 from Wacker K.K.) were used.

The above ingredients were sufficiently blended in a Henschell Mixer and then melt-kneaded by a vent-type two-shaft kneader at 180° C. The resultant mixture was cooled and then roughly pulverized by a feather mill, further pulverized into fine particles by a jet mill (IDS-2 model). Subsequently, the resultant fine particles were subject to air classification and heat-treated at 300° C. by a suffusing system (SFS-1 model available from Japan Pneumatic Industries Co., Ltd.) so as to give the carrier K having the average particle size of about 35 μm.

The carrier L was prepared in the same manner as the carrier K, except for that 100 parts by weight of the resin 9 having the acid value of 30 KOHmg/g and a Tg of 62° C., 350 parts by weight of magnetic powder (available commercially as MFP-2 from TDK Corporation), 3 parts by weight of carbon black having a BET specific surface area of 950 $m^2/g$ (available commercially as Ketchen Black EC from Lion Yushi K.K.) and 1.5 parts by weight of silica having a BET specific surface area of 180 $m^2/g$ (available commercially as #200 from Nippon Aerosil K.K.) were used. Thus was obtained the carrier L having the average particle size of about 30 μm.

The carrier M was prepared in the same manner as the carrier K, except for that 100 parts by weight of the resin 10 having the acid value of 30 KOHmg/g and a Tg of 60° C., 400 parts by weight of magnetic powder (available commercially as EPT-1000 from Toda Industries Ltd.), 2 parts by weight of carbon black having a BET specific surface area of 1270 $m^2/g$ (available commercially as Ketchen Black EC-DJ600 from Lion Yushi K.K.) and 2 parts by weight of silica having a BET specific surface area of 170 $m^2/g$ (available commercially as H2000 from Wacker K.K.) were used. Thus was obtained the carrier M having the average particle size of about 30 μm.

The carrier N was prepared in the same manner as the carrier K, except for that 100 parts by weight of the resin 11 having the acid value of 45 KOHmg/g and a Tg of 65° C., 300 parts by weight of magnetic powder (available commercially as RB-BL from Chitan Industries Ltd.), 5 parts by weight of carbon black having a BET specific surface area of 1270 $m^2/g$ (available commercially as Ketchen Black EC-DJ600 from Lion Yushi K.K.) and 2 parts by weight of silica having a BET specific surface area of 225 $m^2/g$ (available commercially as H3004F from Wacker K.K.) were used. Thus was obtained the carrier N having the average particle size of about 35 μm.

The carrier O was prepared in the same manner as the carrier K, except for that 100 parts by weight of the resin 8 having the acid value of 22 KOHmg/g and a Tg of 60° C., 400 parts by weight of magnetic powder (available commercially as RB-BL from Chitan Industries Ltd.), 5 parts by weight of carbon black having a BET specific surface area of 900 $m^2/g$ (available commercially as NEO SPECTRA MarkII from Columbia Carbon Inc.) and 3 parts by weight of silica having a BET specific surface area of 180 $m^2/g$ (available commercially as #200 from Nippon Aerosil K.K.) were used. Thus was obtained the carrier 0 having the average particle size of about 40 μm.

The carrier P was prepared in the same manner as the carrier K, except for that 100 parts by weight of the resin 10 having the acid value of 30 KOHmg/g and a Tg of 60° C., 250 parts by weight of magnetic powder (available commercially as MFP-2 from TDK Corporation), 8 parts by weight of carbon black having a BET specific surface area of 950 $m^2/g$ (available commercially as Ketchen Black EC from Lion Co., Ltd.) and 2 parts by weight of silica having a BET specific surface area of 180 $m^2/g$ (available commercially as #200 from Nippon Aerosil K.K.) were used. Thus was obtained the carrier P having the average particle size of about 30 μm.

The carrier Q was prepared in the same manner as the carrier K, except for that 100 parts by weight of the resin 12 having the acid value of 0 KOHmg/g and a Tg of 60° C., 300 parts by weight of magnetic powder (available commercially as RB-BL from Titanium Industry Ltd.), 5 parts by weight of carbon black having a BET specific surface area of 94 $m^2/g$ (available commercially as REGAL330 from CABOT Inc.) and 3 parts by weight of silica having a BET specific surface area of 110 $m^2/g$ (available commercially as H1303 from Wacker K.K.) were used. Thus was obtained the carrier Q having the average particle size of about 35 μm.

The carrier R was prepared in the same manner as the carrier K, except for that 100 parts by weight of the resin 13 having the acid value of 3 KOHmg/g and a Tg of 62° C., 400 parts by weight of magnetic powder (available commercially as RB-BL from Titanium Industry Ltd.), 5 parts by weight of carbon black having a BET specific surface area of 950 $m^2/g$ (available commercially as Ketchen Black EC from Lion Yushi K.K.) and 3 parts by weight of silica having a BET specific surface area of 250 $m^2/g$ (available commercially as R976 from Nippon Aerosil K.K.) were used. Thus was obtained the carrier R having the average particle size of about 40 μm.

The carrier S was prepared in the same manner as the carrier K, except for that 100 parts by weight of the resin 13 having the acid value of 3 KOHmg/g and a Tg of 62° C., 250 parts by weight of magnetic powder (available commercially as MFP-2 from TDK Corporation.), 8 parts by weight of carbon black having a BET specific surface area of 250 $m^2/g$ (available commercially as #970 from Mitsubishi Chemical Co., Ltd.) and 2 parts by weight of silica having a BET specific surface area of 180 $m^2/g$ (available commercially as

#200 from Nippon Aerosil K.K.) were used. Thus was obtained the carrier S having the average particle size of about 30 μm.

Two types of toners c–d were prepared in the following manner and blended with the above carriers, respectively.

To prepare the toner c, 100 parts by weight of styreneacryl copolymer (available commercially as Himer SBM73 from Sanyo Chemical Industries Co., Ltd.), 10 parts by weight of carbon black (available commercially as REGAL 330 from CABOT Inc. and having a pH of 9.0), 3 parts by weight of low molecular weight polypropylene (available commercially as Viscol 550P from Sanyo Chemical Industries Co., Ltd.) and 5 parts by weight of quaternary ammonium salt (available commercially as P-51 from Orient Chemical Industries Ltd.) were sufficiently blended and melt-kneaded by a vent-type two-shaft kneader at 140° C. The resultant mixture was cooled and then roughly pulverized by a feather mill, further pulverized into fine particles by a jet mill. Subsequently, the resultant fine particles were subject to air classification, thus giving black fine powder having the average particle size of about 9 μm. Subsequently, 0.3 parts by weight of silica (available commercially as H-2000 from Wacker K.K.) was added to 100 parts by weight of the black fine powder. The resultant mixture was processed by a Henschell Mixer at 1000 rpm for 1 minute to give the positive-charge toner c.

The toner d was prepared in the same manner as the toner c, except for that the quaternary ammonium salt was replaced by 5 parts by weight of nigrosine dye (available commercially as Bontron NB-EX from Orient Chemical Industries Co., Ltd.) and the carbon black was replaced by 10 parts by weight of MA#8 available from Mitsubishi Chemical Industries Co., Ltd. Thus was obtained the positive-charge toner d having the average particle size of about 8.5 μm.

Developers of Examples 11–16 contain the carriers K–P respectively, whereas developers of Examples 17–19 contain the carriers Q–S respectively. The carriers K–S and toners c–d were combined as shown in Table 4. Each of the developers contained 10 wt % of toner.

TABLE 4

| | Examples | | | | | | | | |
|---|---|---|---|---|---|---|---|---|---|
| | 11 | 12 | 13 | 14 | 15 | 16 | 17 | 18 | 19 |
| Type of Carrier | K | L | M | N | O | P | Q | R | S |
| Type of Toner | c | c | c | d | d | d | c | c | d |

The developers of Examples 11–19 were each put in a 50-cc plastic vessel, which was placed on a rotary table rotated at 120 rpm for 3, 10, 60 or 600 minutes. The test was conducted using the apparatus shown in FIG. 3. Each of the developers thus prepared was weighed on a precision balance to obtain a sample of 1 g thereof. The sample thus obtained was uniformly applied to the surface of the conductive sleeve 31. The rotation speed of the magnetic roller 32 in the conductive sleeve 31 was set to 100 rpm. A bias voltage of 3 kV having the opposite polarity to that of the toner was applied by a bias voltage source 33 while the magnetic roller 32 was rotated for 30 seconds. Then, a potential level Vm of the cylindrical electrode 34 was read at the time when the magnetic roller 32 was stopped. On the other hand, an amount of toner fed from the conductive sleeve and deposited on the cylindrical electrode 34 was measured by means of the precision balance for determination of the average charge level (μC/g) of each of the toners.

Next, samples of the developers of Examples 11–19 were prepared by putting the respective developers in a 50-cc plastic vessel rotated for 60 minutes. Similarly to the above, each of the developers was uniformly applied to the surface of the conductive sleeve 31. A bias voltage of 1 kV having the same polarity with that of the toner was applied by a bias voltage source 33 while the magnetic roller 32 was rotated in the same manner as the aforesaid measurement of the charge level. Then, a weight of the toner deposited on the cylindrical electrode 34 was measured by means of the precision balance to find an amount of the countercharged toner (wt %) with respect to the whole toner. The results are shown in Table 5.

TABLE 5

| | Charge Level (μC/g) | | | | Amount of Counter-charged Toner |
|---|---|---|---|---|---|
| | 3 min | 10 min | 60 min | 600 min | (wt %) |
| Ex. 11 | 22.5 | 22.4 | 23.0 | 22.9 | 0.5 |
| Ex. 12 | 21.0 | 21.8 | 21.5 | 21.6 | 0.7 |
| Ex. 13 | 27.0 | 26.9 | 26.5 | 27.1 | 0.3 |
| Ex. 14 | 22.1 | 22.5 | 22.9 | 22.5 | 1.5 |
| Ex. 15 | 20.9 | 20.5 | 20.8 | 20.6 | 1.0 |
| Ex. 16 | 26.8 | 26.5 | 26.9 | 26.6 | 1.1 |
| Ex. 17 | 9.8 | 13.9 | 15.0 | 17.8 | 9.3 |
| Ex. 18 | 11.0 | 12.1 | 19.5 | 23.9 | 4.1 |
| Ex. 19 | 8.5 | 13.0 | 17.2 | 8.0 | 7.9 |

As apparent from the results, the developers of Examples 11–16 each present stable charge level of the toner contained therein. As to the developers of Examples 17–19, in contrast, the toners contained therein present low rising edges of charging and fail to accomplish sufficient charging. The developers of Examples 11–16 present small amounts of countercharged toners whereas the developers of Examples 17–19 present great amounts of countercharged toners.

Next, the developers of Examples 11–19 were each applied to the developing unit 10 of FIG. 1, which was adjusted as follows. A gap between the developer sleeve 11 and magnetic blade 13 was adjusted so as to regulate an amount of the developer 1 to 5.0 mg/cm$^2$, the developer transported by the developer sleeve 11 to the development region. On the other hand, a minimum gap between the photoconductor drum 2 and developer sleeve 11 opposite thereto was adjusted to 0.3 mm. The photoconductor drum 2 was rotated at a circumferential speed of 165 mm/s whereas the developer sleeve 11 was rotated at a circumferential speed of to 300 mm/s. The photoconductor drum 2 had a surface potential of −450 V at a portion thereof to which the toner T was supplied and a surface potential of −100 V at a portion thereof to which the toner T was not supplied.

Then, a developing bias voltage was applied to the development region where the developer sleeve 11 opposes the photoconductor drum 2, thereby developing normal images, which were transferred on copy sheets. The printed images were subject to evaluation. The developing bias voltage was produced by superimposing a DC voltage of −200 V from the developing bias voltage source 12 on an AC voltage having a peak-to-peak value Vp-p of 1.4 kV, a rectangular wave of a frequency of 3 kHz and a duty ratio (development:recovery) at 1:1.

For evaluation of the resultant images, 100,000 copies were produced by the use of the individual developers. From these copies, the initial, the 10,000-th and the 100,000-th copies were picked up so that images thereon were examined for the density variation, carrier adhesion and fog. The results are shown in Table 6. The respective images were visually inspected for the density variation and classified into five levels of quality. That is, an image free from density variation was given 5, an image with an insignificant degree of density variation 4, an image with some degree of density variation 3, an image with a high degree of density variation 2, and an image with a rather high degree of density variation 1. The images were also visually inspected for the occurrence of fog and classified into five levels of quality. That is, an image free from fog was given 5, an image with an insignificant degree of fog 4, an image with some degree of fog 3, an image with a high degree of fog 2, and an image with a rather high degree of fog 1.

TABLE 6

| | Density Variation | | | Fog | | |
|---|---|---|---|---|---|---|
| | Initial | 10000-th | 100000-th | Initial | 10000-th | 100000-th |
| Ex. 11 | 5 | 5 | 5 | 5 | 5 | 5 |
| Ex. 12 | 5 | 5 | 4 | 5 | 5 | 5 |
| Ex. 13 | 5 | 5 | 4 | 5 | 4 | 4 |
| Ex. 14 | 5 | 4 | 4 | 5 | 5 | 5 |
| Ex. 15 | 4 | 4 | 4 | 5 | 4 | 4 |
| Ex. 16 | 5 | 5 | 4 | 5 | 4 | 4 |
| Ex. 17 | 3 | 2 | 2 | 2 | 1 | 1 |
| Ex. 18 | 2 | 2 | 2 | 3 | 3 | 2 |
| Ex. 19 | 2 | 1 | 1 | 2 | 2 | 1 |

As apparent from the results, the developers of Examples 11–16 assure stable production of favorable images substantially free from density variation and fog over a long period of time. In contrast, the developers of Examples 17–19 gradually deteriorate in the performance of rendering images of good quality, suffering an increasing occurrence of density variation or fog in the resultant images as used long.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be constructed as being included therein.

What is claimed is:

1. A development method comprising the steps of:

forming a layer of a developer comprising a negative-charge toner and a magnetic carrier on a developer transporting member containing a magnet therein by means of a developer regulating member, said carrier comprising a magnetic powder dispersed in a binder resin possessing an acid value of 0 to 20 KOHmg/g, and having 5 to 30 wt % of magnetic powder present on the surface of thereof, transporting the developer layer, as carried on the developer transporting member, to a development region wherein said developer transporting member opposes an image bearing member, and applying an oscillating electric field to said development region for supplying the toner from the developer layer to said image bearing member, thereby developing an image.

2. A development method as set forth in claim 1, wherein an amount of the developer composing said developer layer is in the range of from 0.7 to 10.0 mg/cm$^2$.

3. A development method as set forth in claim 2, wherein an amount of the developer composing said developer layer is in the range of from 0.8 to 7.5 mg/cm$^2$.

4. A development method as set forth in claim 2, wherein the relationship between a gap Ds between said developer transporting member and image bearing member and a peak-to-peak value Vp-p of an AC voltage applied to said developer transporting member satisfies the condition of 3.5 KV/mm$\leqq$Vp-p/Ds$\leqq$5.5 KV/mm.

5. A development method as set forth in claim 2, wherein said developer regulating member comprises a magnetic blade.

6. A development method as set forth in claim 1, wherein an amount of the magnetic powder present on the surface of said carrier is in the range of from 10 to 25 wt %.

7. A development method as set forth in claim 1, wherein said carrier has a volumetric average particle size of 10 to 50 μm and contains therein 150 to 500 parts by weight of magnetic powder to 100 parts by weight of binder resin.

8. A development method as set forth in claim 7, wherein said carrier has a volumetric average particle size of 20 to 45 μm and contains therein 250 to 400 parts by weight of magnetic powder to 100 parts by weight of binder resin, with 10 to 20 wt % of magnetic powder present on the surface thereof.

9. A development method as set forth in claim 7, wherein said carrier has a dynamic current value of 5 to 50 nA.

10. A development method as set forth in claim 1, wherein said carrier contains therein a carbon black having a BET specific surface area of 700 to 1400 m$^2$/g and a pH not smaller than 7.

11. A development method as set forth in claim 1, wherein said carrier contains therein a silica having a BET specific surface area of 100 to 250 m$^2$/g.

12. A development method comprising the steps of:

forming a layer of a developer comprising a positive-charge toner and a magnetic carrier on a developer transporting member containing a magnet therein by means of a developer regulating member, said carrier comprising a magnetic powder dispersed in a binder resin possessing an acid value of 20 to 70 KOHmg/g, transporting the developer layer, as carried on the developer transporting member, to a development region wherein said developer transporting member opposes an image bearing member, and applying an oscillating electric field to said development region for supplying the toner from the developer layer to said image bearing member, thereby developing an image.

13. A development method as set forth in claim 12, wherein an amount of the developer composing said developer layer is in the range of from 0.7 to 10.0 mg/cm$^2$.

14. A development method as set forth in claim 13, wherein an amount of the developer composing said developer layer is in the range of from 0.8 to 7.5 mg/cm$^2$.

15. A development method as set forth in claim 13, wherein the relationship between a gap Ds between said developer transporting member and image bearing member and a peak-to-peak value Vp-p of an AC voltage applied to said developer transporting member satisfies the condition of 3.5 KV/mm$\leqq$Vp-p/Ds$\leqq$5.5 KV/mm.

16. A development method as set forth in claim 13, wherein the binder resin contained in said carrier possesses an acid value of 30 to 50 KOHmg/g.

17. A development method as set forth in claim 12, wherein said carrier has a volumetric average particle size of 10 to 50 μm and contains therein 150 to 500 parts by weight of magnetic powder to 100 parts by weight of binder resin.

18. A development method as set forth in claim 17, wherein said carrier has a volumetric average particle size of 20 to 45 μm and contains therein 250 to 400 parts by weight of magnetic powder to 100 parts by weight of binder resin.

19. A development method as set forth in claim 13, wherein said carrier contains therein a carbon black having a BET specific surface area of 700 to 1400 $m^2/g$.

20. A development method as set forth in claim 13, wherein said carrier contains therein a silica having a BET specific surface area of 100 to 250 $m^2/g$.

* * * * *